US005876222A

United States Patent [19]

Gardner et al.

[11] Patent Number: 5,876,222

[45] Date of Patent: Mar. 2, 1999

[54] ELECTRICAL CONNECTOR FOR PRINTED CIRCUIT BOARDS

[75] Inventors: Michael J. Gardner, Wheaton; Alan S. Walse, La Grange, both of Ill.

[73] Assignee: Molex Incorporated, Lisle, Ill.

[21] Appl. No.: 965,984

[22] Filed: Nov. 7, 1997

[51] Int. Cl.[6] ..... H01R 9/09

[52] U.S. Cl. ..... 439/79; 439/607

[58] Field of Search ..... 439/79, 80, 607

[56] References Cited

U.S. PATENT DOCUMENTS

| | | | |
|---|---|---|---|
| 4,580,858 | 4/1986 | Daberkoe | 339/17 LC |
| 4,875,865 | 10/1989 | Demler, Jr. et al. | 439/101 |
| 4,968,261 | 11/1990 | Mizunuma | 439/108 |
| 5,195,154 | 3/1993 | Uchida | 385/88 |
| 5,199,885 | 4/1993 | Korsunsky et al. | 439/79 |
| 5,201,664 | 4/1993 | Korsunsky et al. | 439/83 |
| 5,259,768 | 11/1993 | Brunker et al. | 439/60 |
| 5,277,618 | 1/1994 | Mitra | 439/564 |
| 5,320,541 | 6/1994 | Korsunsky et al. | 439/79 |
| 5,326,936 | 7/1994 | Taniuchi et al. | 174/260 |
| 5,350,307 | 9/1994 | Takagishi et al. | 439/79 |
| 5,383,095 | 1/1995 | Korsunsky et al. | 361/785 |
| 5,540,598 | 7/1996 | David | 439/79 |
| 5,622,519 | 4/1997 | Bixler et al. | 439/570 |

FOREIGN PATENT DOCUMENTS 706724 1/1997 European Pat. Off. .

OTHER PUBLICATIONS

AMP Catalog 65972, revised in Apr. of 1995, Part Nos. 787096–1, 787046–1 and 787095–1.

*Primary Examiner*—Edgar Burr
*Assistant Examiner*—Daniel J. Colilla
*Attorney, Agent, or Firm*—Charles S. Cohen

[57] ABSTRACT

An electrical connector is adapted for mounting on a printed circuit board. The connector includes a dielectric housing having at least one row of terminal-receiving passages. A plurality of terminals are received in the passages and include tail portions in a row for connection to appropriate circuit traces on the printed circuit board. The tail portions of some of the terminals in the row are adapted for insertion into holes in the circuit board. The tail portions of other of the terminals in the row are adapted for surface mounting on the circuit board. Tail portions of some of the terminals extend through holes in the tail aligner while enlarged cutout areas in the tail aligner accommodate the surface mount tail portions of the others of the terminals.

19 Claims, 4 Drawing Sheets

ELECTRICAL CONNECTOR FOR PRINTED CIRCUIT BOARDS

FIELD OF THE INVENTION

This invention generally relates to the art of electrical connectors and, particularly, to an improved terminal arrangement for an electrical connector mounted on a printed circuit board.

BACKGROUND OF THE INVENTION

Generally, a typical electrical connector includes some form of dielectric or insulative housing which mounts a plurality of conductive terminals. It is well known to provide electrical connectors mounted to a printed circuit board, with contact terminals therein electrically coupled to respective electrical circuit traces on the board. The terminals typically have solder tails projecting from the connector and inserted into holes in the board, or the terminals may have leg portions generally parallel to the board for surface mounting in electrical engagement with circuit pads on the board. In either instance, the terminals are coupled to the circuit traces on the board most commonly by solder connections, either between the solder tails and plated through-holes in the board or between the surface mounted leg portions and the circuit pads on the board surface.

Circuit board mounted electrical connectors of the character described above typically have the terminals mounted in the connector housing such that the solder tails or the surface mounted leg portions are arranged in rows for solder connection to rows of plated through-holes in the board or rows of circuit pads on the board surface. In high density or fine pitch connectors, a single row of terminals in a housing may have solder tails arranged in two separate staggered rows. Unfortunately, staggering solder tails can lead to problems in high speed applications due to the fact that adjacent terminals have different electrical path lengths. Such different electrical path lengths may result in undesirable signal skew in some applications.

Surface mounted terminals generally provide better electrical performance than the through-hole terminals because the surface mount pads to which the surface mounted terminals are soldered have less capacitance than the through holes to which the through hole terminals are soldered. The capacitance of the through holes can create impedance problems detrimental to the integrity of high-performance signals. Additionally, surface mount pads can be laid out "on pitch" or closer together than through holes thus negating the need to stagger solder tail portions. Consequently, adjacent terminals with surface mount tail portions can have equal electrical path lengths which is also beneficial in high speed applications. Therefore, high performance or high speed terminals are often best configured with surface mounted leg portions.

On the other hand, surface mounted leg portions have a greater tendency to strip off of the circuit pads on the board surface when the terminals are subjected to undesirable shearing forces. Through-hole solder tails provide considerably more mechanical strength at the interconnection interfaces between the terminals and the through holes of the board.

It has been known to provide an electrical connector with a row of terminals with through-hole solder tails as well as a row of terminals with surface mounted leg portions. However, such hybrid row configurations place considerable limits on the circuit design variables of the electrical connector. The present invention is directed to solving the problems or dilemma described above by providing an electrical connector with a unique, versatile terminal arrangement.

SUMMARY OF THE INVENTION

An object, therefore, of the invention is to provide a new and improved electrical connector for mounting on a printed circuit board.

In the exemplary embodiment of the invention, the connector includes a dielectric housing having at least one row of terminal-receiving passages. A plurality of terminals are received in the passages and include tail portions extending out of the housing for connection to appropriate circuit traces on the printed circuit board. The tail portions of some of the terminals in the row are adapted for insertion into holes in the circuit board and are the sole means of connecting the terminals to the circuit traces on the board. The tail portions of other of the terminals in the row are adapted for surface mounting on the circuit board and are the sole means of connecting the terminals to the circuit traces on the board.

The connector is shown herein as a right-angled connector with a mating end extending in a direction generally parallel to the printed circuit board. The terminals have right-angled configurations and include contact portions extending in the direction of the mating end of the connector and tail portions extending generally perpendicular to the contact portions. The terminals are stamped and formed from conductive sheet metal material.

Another feature of the connector is a tail aligner through which the tail portions of the terminals extend. The tail aligner includes holes through which the through-hole tail portions extend, and the tail aligner includes enlarged cutout areas for accommodating the surface mount tail portions. As disclosed herein, the enlarged cutout ares of the tail aligner are located at an edge thereof.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
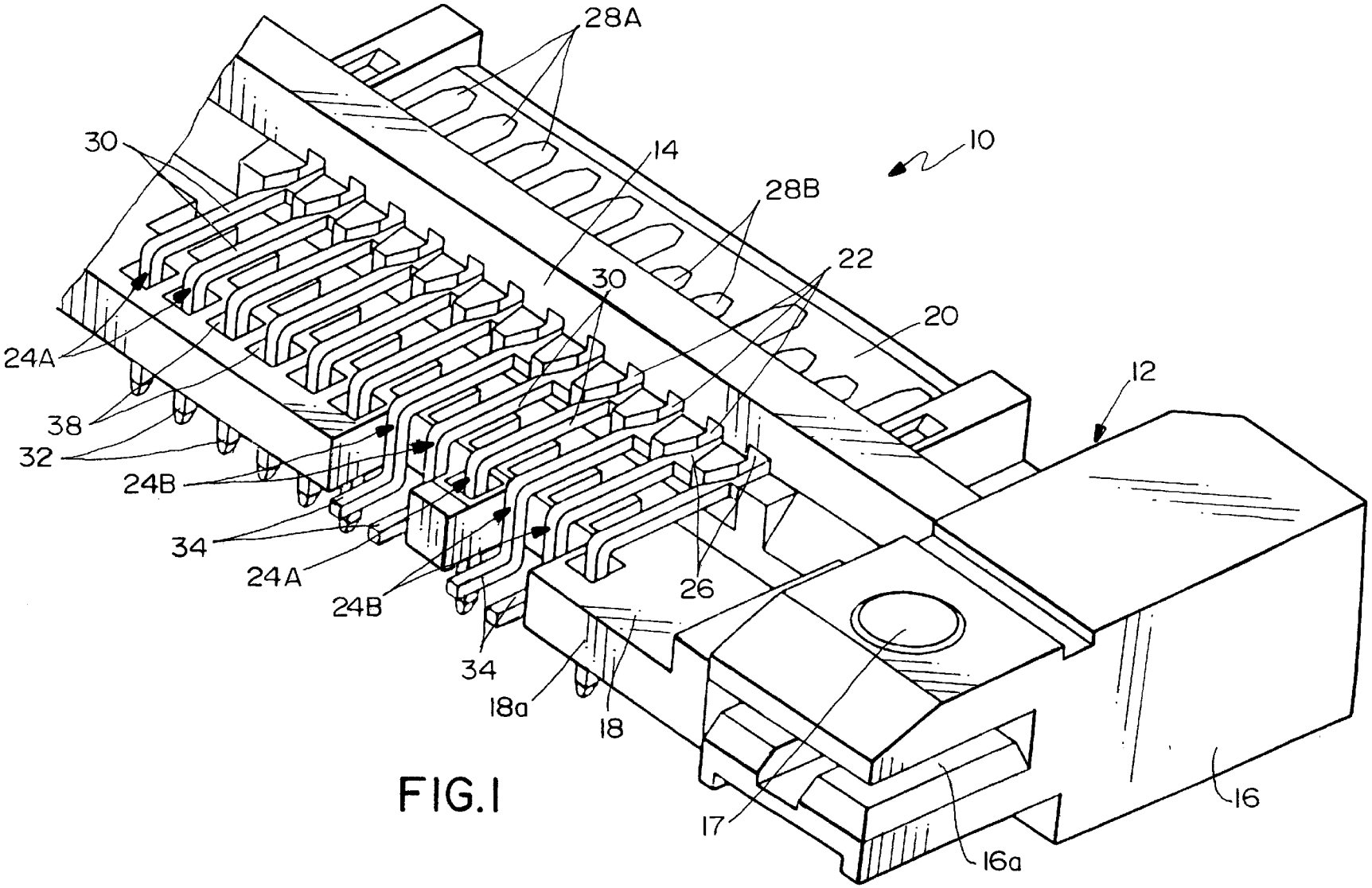
FIG. 1 is a rear fragmented perspective view of an embodiment of an electrical connector according to the invention.

Referring to the drawings in greater detail, and first to FIG. 1, the invention is incorporated in an electrical connector, generally designated 10, which includes an elongated dielectric housing, generally designated 12. The housing includes an elongated flange or body portion 14 extending between a pair of end mounting portions 16. (Only one of such ends 16 is shown in FIG. 1). The mounting portions may have depending mounting pegs 17 for insertion into appropriate mounting holes in a printed circuit board. Alternatively or additionally, the mounting portions may have mounting clips (not shown) inserted into slots 16*a* of the mounting portion for securing the connector to the circuit board. An example of such mounting clips are shown in U.S. Pat. No. 5,622,519, dated Apr. 22, 1997 and assigned to the assignee of the present invention.

A tail aligner plate 18 extends longitudinally between end mounting portions 16 and projects rearwardly of elongated flange 14. At least one mating portion 20 extends longitudinally between end mounting portions 16 and projects forwardly of elongated flange 14. Housing 12 is unitarily molded of dielectric material such as plastic or the like, and forwardly projecting mating portion 20 is molded integrally therewith. On the other hand, rearwardly projecting tail aligner 18 is a separate generally planar component that may snappingly interengage the housing between end mounting portions 16 by appropriate snap-latch means as is known in the art.

Still referring to FIG. 1, housing 12 of connector 10 includes at least one row of terminal-receiving passages 22 in which a plurality of terminals 24A and 24B are mounted. Each terminal includes a body portion 26 fixed within a respective one of passages 22. The terminals have blade-like contact portions 28A and 28B disposed on one or both sides of mating portion 20. Typically, the blade-like contact portions 28A and 28B are located in recesses or channels in the mating portion 20. Each terminal 24A and 24B includes a tail portion 30 projecting rearwardly of elongated flange 14 of housing 12. The connector is a right-angled connector with mating portion 20 facing in a direction generally parallel to the printed circuit board to which it will be mounted. Consequently, terminals 24A and 24B have right-angled configurations as best seen in FIGS. 1 and 3.

According to the invention, some of the terminals, namely terminals 24A, have solder tails 32 adapted for insertion into through-holes in a printed circuit board and arranged in a single row, with the solder tails being the sole means of connecting terminals 24A to circuit traces on the board. Other of the terminals, namely terminals 24B, have surface mount leg portions 34 for surface mounting to circuit pads 42 (FIG. 2) on the printed circuit board, and the surface mount leg portions are the sole means of connecting terminals 24B to circuit traces on the printed circuit board.

Figure 2:
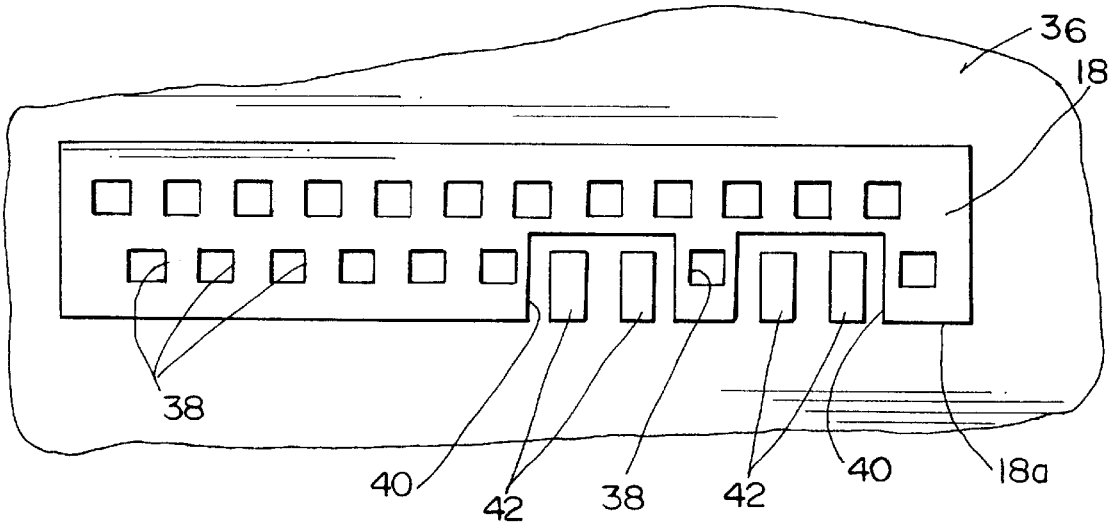
FIG. 2 is a somewhat schematic illustration of the tail aligner isolated from the connector of FIG. 1 in conjunction with underlying surface mount circuit pads on a printed circuit board.

Referring to FIG. 2 in conjunction with FIG. 1, tail aligner 18 is shown in FIG. 2 somewhat schematically, isolated from the remainder of the connector, and in conjunction with a printed circuit board 36. As seen in both FIGS. 1 and 2, the tail aligner has holes 38 through which solder tails 32 of terminals 24A extend. Although not visible in FIG. 2, holes 38 in tail aligner 18 will be aligned with plated through-holes in printed circuit board 36 so that solder tails 32 can be inserted into the through-holes in the board and solder connected to the circuit traces extending into the plated through-holes. Tail aligner 18 also has enlarged cutout areas 40 for accommodating surface mount leg portions 34 of terminals 24B. It can be seen that the cutout areas are located at a rear edge 18a of the tail aligner. The cutout areas are shown to surround circuit pads 42 on the surface of printed circuit board 36. Therefore, whereas holes 38 in the tail aligner allow for solder tails 32 of terminals 24A to be inserted therethrough, cutout areas 40 allow surface mount leg portions 34 of terminals 24B to pass the tail aligner and into engagement with circuit pads 42 on the printed circuit board.

Figure 3:
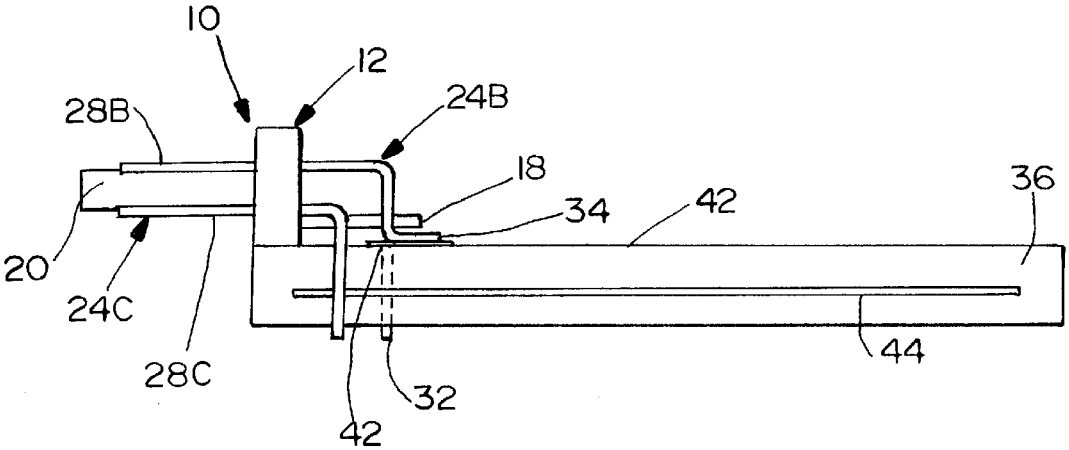
FIG. 3 is a somewhat schematic illustration of the connector of FIG. 1 mounted on a printed circuit board generally at the edge thereof.

FIG. 3 is a somewhat schematic illustration of connector 10, including housing 12, mounted on the top of printed circuit board 36. It can be seen that a second row of terminals 24C is mounted in the housing with contact blades 28C being located on the underside of mating portion 20. These terminals are not visible in FIG. 1. Nevertheless, FIG. 3 shows one of the terminals 24 with its surface mounted leg portion 34 in engagement with a circuit pad or trace 42 on the top surface of circuit board 36. FIG. 3 also shows a solder tail 32 from one of the terminals 24A in the same row as terminals 24B extending through the circuit board. Solder tail 32 of terminal 24A is solder connected to an internal ground plane 44 of the printed circuit board by means of the plated through-holes in the board. In addition, the terminal 24C of the other row of terminals is also solder connected to the ground plane 44.

From the foregoing, it can be seen that the invention has provided an arrangement whereby some of the terminals 24A have solder tails 32 and some of the terminals 24B have surface mount leg portions 34 all projecting from a single row lengthwise of the housing. Surface mount leg portions 34 allow for terminals 24B to be used as high performance or high speed terminals without the capacitance problems created by through-hole connections. On the other hand, solder tails 32 of terminals 24A in the very same row as terminals 24B provides considerable connector-to-board strength. Terminals 24A can be used as power or ground terminals which are less affected by capacitance, again all projecting from the same row as surface mount terminals 24B.

Figure 4:
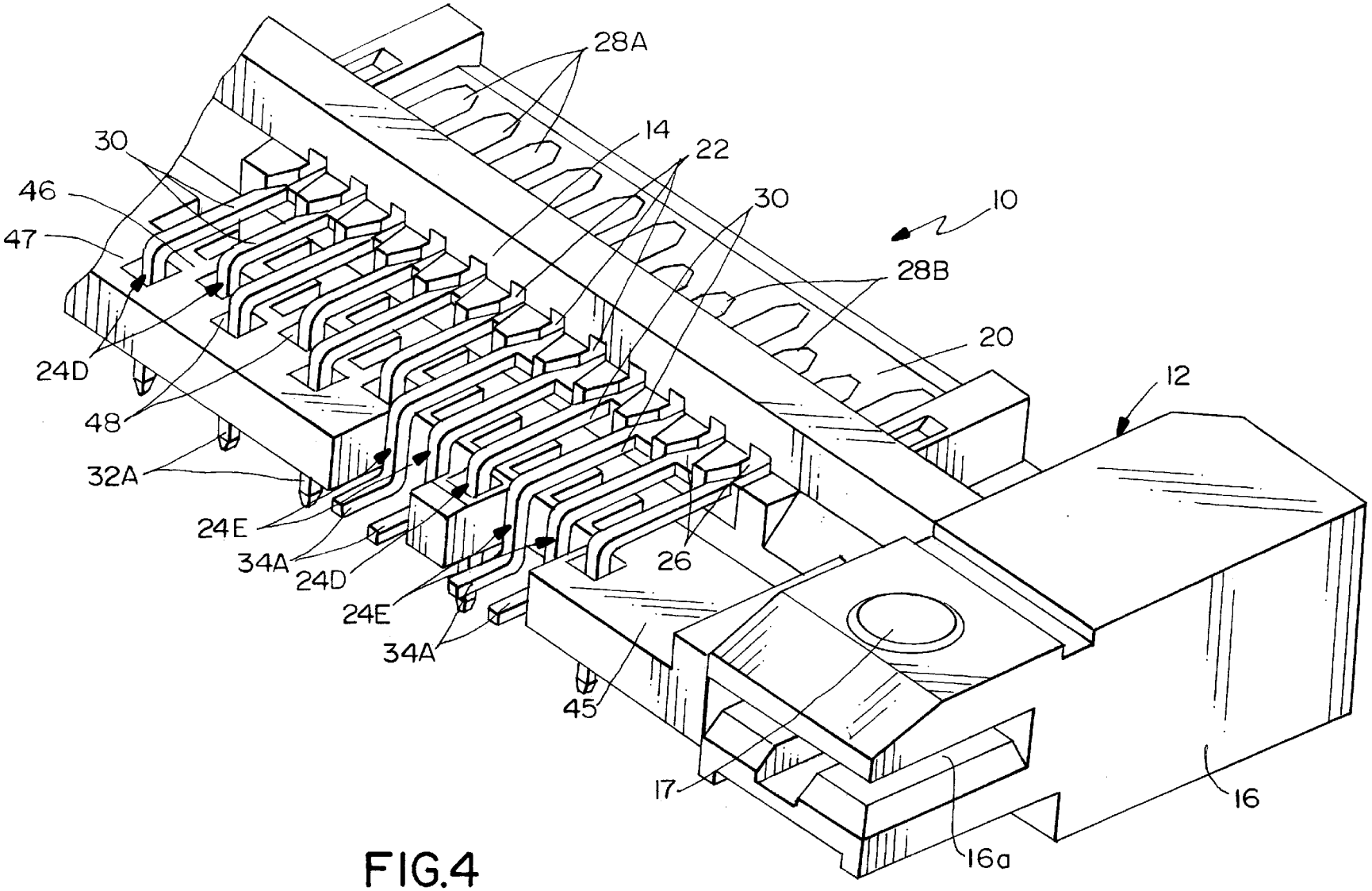
FIG. 4 is a rear fragmented perspective view of an alternate embodiment of an electrical connector according to the invention with the tail portions of terminals, adapted for through hole soldering, being offset laterally, or staggered.
Figure 5:
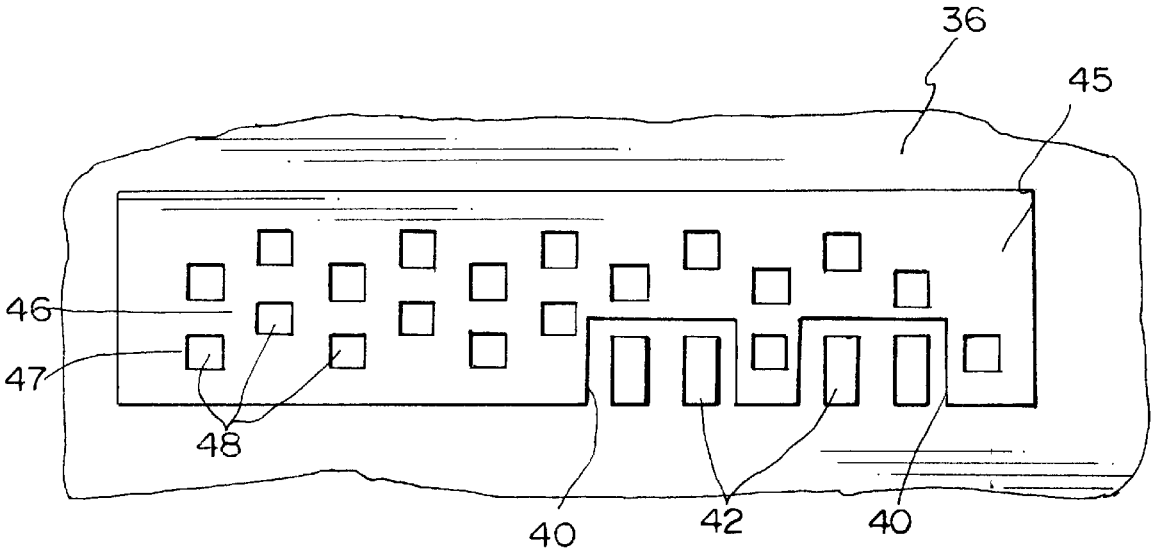
FIG. 5 is a fragmented somewhat schematic illustration of the tail aligner isolated from the connector of FIG. 4 in conjunction with the underlying surface mount circuit pads on a printed circuit board.

FIGS. 4 and 5 are an alternate embodiment of the invention which could be utilized in high density, or fine pitch applications. Like numerals have been used in FIGS. 4 and 5 to reflect like components of FIGS. 1–3. The invention is incorporated in an electrical connector generally designated 10 which includes a housing 12 having at least one row of terminal-receiving passages 22 in which a plurality of right angle terminals 24D and 24E are mounted. The terminal tail portions project rearwardly of the housing and are adapted to be coupled to circuit traces on a printed circuit board.

Still referring to FIG. 4, according to the invention, some of the terminals, namely terminals 24D, have solder tails 32A adapted for insertion into through-holes in a printed circuit board and arranged in a first row 46 and second row 47 offset laterally or staggered in relation to each other, with the solder tails being the sole means of connecting terminals 24D to circuit traces on the board. Other of the terminals, namely terminals 24E, have surface mount leg portions 34A for surface mounting to circuit pads 42 (FIG. 5) on the printed circuit board 36, and the surface mount leg portions are the sole means of connecting terminals 24E to circuit traces on the printed circuit board.

Referring to FIG. 5 in conjunction with FIG. 4, tail aligner 45 is shown in FIG. 5 somewhat schematically, isolated from the remainder of the connector, and in conjunction with a printed circuit board 36. As seen in both FIGS. 4 and 5, the tail aligner has staggered holes 48 through which solder tails 32A of terminals 24D extend. Although not visible in FIG. 5, the staggered holes 48 in tail aligner 45 will be aligned with the staggered plated through-holes in printed circuit board 36 so that solder tails 32A can be inserted into the through-holes in the board and solder connected to the circuit traces extending into the plated through-holes. Tail aligner 45 also has enlarged cutout areas 40 located at an edge of the tail aligner for accommodating surface mount leg portions 34A of terminals 24E.

From the foregoing, it can be seen that the alternate embodiment provides an arrangement whereby some of the terminals 24D have solder tails 32A and some of the terminals 24E have surface mount leg portions 34A all extending from a single row in the housing. The terminals with the surface mount leg portions 34A have generally equal electrical path lengths and allow for terminals 24E to be used as high performance or high speed terminals without signal skew problems caused by unequal electrical path length and without the capacitance problems created by through-hole connections. On the other hand, the staggered solder tails 24D of terminals provide considerable connector-to-board strength and can be used as power or ground terminals which are less affected by capacitance and unequal electrical path lengths.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. An electrical connector for mounting on a printed circuit board, comprising:

a dielectric housing having at least one row of terminal-receiving passages;

a plurality of terminals received in said passages and including tail portions in a row for connection to appropriate circuit traces on the printed circuit board, the tail portions of some of the terminals in said row being adapted for insertion into holes in the circuit board and being the sole means of connecting said some of the terminals to the circuit traces on the board, and the tail portions of other of the terminals in said row being adapted for surface mounting on the circuit board and being the sole means of connecting said other of the terminals to the circuit traces on the board; and a tail aligner through which the tail portions of the terminals extend, the tail aligner including holes through which the tail portions of said some of the terminals extend, and the tail aligner including enlarged cutout areas adjacent an edge of said tail aligner for accommodating the tail portions of said other of the terminals.

2. The electrical connector of claim 1 wherein the connector is a right-angled connector with a mating portion facing in a direction generally parallel to the printed circuit board.

3. The electrical connector of claim 2 wherein said terminals have right-angled configurations, including contact portions extending in said direction of the mating portion of the connector, and said tail portions extending generally perpendicular to the contact portions.

4. The electrical connector of claim 1 wherein said terminals are stamped and formed from conductive sheet metal material.

5. An electrical connector for mounting on a printed circuit board, comprising:

a right-angled dielectric housing having a mating portion facing in a direction generally parallel to the printed circuit board and at least one row of terminal-receiving passages; and a plurality of terminals received in said passages, the terminals being stamped and formed from conductive sheet metal material and having right-angled configurations with contact portions extending in said direction of the mating portion of the connector and tail portions extending in a row generally perpendicular to the contact portions for connection to appropriate circuit traces on the printed circuit board, the tail portions of some of the terminals in said row being adapted for insertion into holes in the circuit board and being the sole means of connecting said some of the terminals to the circuit traces on the board, and the tail portions of other of the terminals in said row being adapted for surface mounting on the circuit board and being the sole means of connecting said other of the terminals to the circuit traces on the board.

6. The electrical connector of claim 5, including a tail aligner through which the tail portions of the terminals extend, the tail aligner including holes through which the tail portions of said some of the terminals extend, and the tail aligner including enlarged cutout areas for accommodating the tail portions of said other of the terminals.

7. The electrical connector of claim 6 wherein said enlarged cutout areas of the tail aligner are located at an edge of the tail aligner.

8. An electrical connector for mounting on a printed circuit board, comprising:

a dielectric housing having first and second generally parallel rows of a plurality of terminal-receiving passages, said housing having a mating portion extending forwardly from an elongated flange and generally between said rows of terminal receiving passages; and first and second pluralities of terminals received in respective ones of said first and second rows of passages, each terminal including a contact portion for mating with a complementary mating connector and a tail portion for connection to appropriate circuit traces on the printed circuit board, the contact portions of said first plurality of terminals being located on a first side of said mating portion and the contact portions of said second plurality of terminals being located on a second side of said mating portion, said second side being opposite said first side, the tail portions of said first plurality of terminals being adapted for insertion into a hole in the circuit board and being the sole means of connecting the terminals to respective circuit traces on the board, and the tail portion of at least one of the second plurality of terminals being adapted for insertion into a hole in the circuit board and being the sole means of connecting the terminals to respective circuit traces on the board, the tail portion of at least one other of the second plurality of terminals being adapted for surface mounting on the board and being the sole means for connecting the other terminal to a circuit trace on the board.

9. The electrical connector of claim 8 wherein the connector is a right-angled connector and said mating portion extends in a direction generally parallel to the printed circuit board.

10. The electrical connector of claim 9 wherein said terminals have right-angled configurations and said tail portions extending generally perpendicular to the contact portions.

11. The electrical connector of claim 8 wherein said terminals are stamped and formed from conductive sheet metal material.

12. The electrical connector of claim 8, including a tail aligner through which the tail portions of the terminals extend, the tail aligner including a hole through which the tail portion of said at least one of said second plurality of terminal extends, and the tail aligner including an enlarged cutout area for accommodating the tail portion of said at least one other of said second plurality of terminals.

13. The electrical connector of claim 12 wherein said enlarged cutout area of the tail aligner is located at an edge of the tail aligner.

14. An electrical connector for mounting on a printed circuit board, comprising:

a dielectric housing having at least one row of terminal-receiving passages;

a plurality of terminals received in said passages and including tail portions for connection to appropriate circuit traces on the printed circuit board, the tail portions of some of the terminals in said row adapted for insertion into holes in the circuit board and arranged in first and second rows such that the first row is staggered from the second row, and being the sole means of connecting said some of the terminals to the circuit traces on the board, and the tail portions of other of the terminals in said row adapted for surface mounting on the circuit board and being the sole means of connecting said other of the terminals to the circuit traces on the board; and a tail aligner through which the tail portions of the terminals extend, the tail aligner including holes through which the tail portions of said some of the terminals extend, and the tail aligner including enlarged cutout areas adjacent an edge of said tail aligner for accommodating the tail portions of said other of the terminals.

15. The electrical connector of claim 14 wherein the connector is a right-angled connector with a mating portion facing in a direction generally parallel to the printed circuit board.

16. The electrical connector of claim 15 wherein said terminals have right-angled configurations, including contact portions extending in said direction of the mating portion of the connector, and said tail portions extending generally perpendicular to the contact portions.

17. The electrical connector of claim 14 wherein said terminals are stamped and formed from conductive sheet metal material.

18. The electrical connector of claim 14, including a tail aligner through which the tail portions of the terminals extend, the tail aligner including holes through which the tail portions of said some of the terminals extend, and the tail aligner including enlarged cutout areas for accommodating the tail portions of said other of the terminals.

19. The electrical connector of claim 18 wherein said enlarged cutout areas of the tail aligner are located at an edge of the tail aligner.

* * * * *